US010669070B2

(12) United States Patent
Lane, II et al.

(10) Patent No.: US 10,669,070 B2
(45) Date of Patent: Jun. 2, 2020

(54) MODULAR DRINKING CONTAINER WITH SURFACE FOR ATTACHING COMPONENTS THERETO

(71) Applicant: Time On Target Holdings, LLC, Vinemont, AL (US)

(72) Inventors: David E. Lane, II, Atlanta, GA (US); John Glenn Kerwood, Canton, GA (US); Roy Luther Manley, Vinemont, AL (US); Steven Bruce Willingham, Vinemont, AL (US); Craig Brian Willingham, Danville, AL (US)

(73) Assignee: Time On Target Holdings, LLC, Vinemont, AL (US)

( * ) Notice: Subject to any disclaimer, the term of this patent is extended or adjusted under 35 U.S.C. 154(b) by 101 days.

(21) Appl. No.: 15/674,259

(22) Filed: Aug. 10, 2017

(65) Prior Publication Data

US 2018/0072461 A1 Mar. 15, 2018

Related U.S. Application Data

(60) Provisional application No. 62/373,112, filed on Aug. 10, 2016.

(51) Int. Cl.

| | |
|---|---|
| ***B65D 25/34*** | (2006.01) |
| ***A47G 19/22*** | (2006.01) |
| ***B65D 81/38*** | (2006.01) |
| ***B65D 25/28*** | (2006.01) |

(52) U.S. Cl.

CPC ..... *B65D 25/34* (2013.01); *A47G 19/2205* (2013.01); *A47G 19/2288* (2013.01); *B65D 25/2811* (2013.01); *B65D 81/3867* (2013.01); *B65D 81/3886* (2013.01)

(58) Field of Classification Search

CPC ..... B65D 25/34; B65D 81/3886; B65D 25/2811; B65D 81/3867; B65D 2525/285; B65D 25/2817; A47G 19/2205

USPC ..... 220/903, 23.86, 23.89, 703, 500, 705

See application file for complete search history.

(56) References Cited

U.S. PATENT DOCUMENTS

| | | | | |
|---|---|---|---|---|
| 4,702,385 | A * | 10/1987 | Shillington | A61B 50/362 220/210 |
| 5,402,903 | A * | 4/1995 | Mann | B65D 81/361 220/23.6 |
| 6,332,557 | B1 * | 12/2001 | Moran | A47J 41/0083 215/12.1 |
| D620,310 | S | 7/2010 | Lundberg | |
| D620,317 | S | 7/2010 | Lundberg | |
| D620,759 | S | 8/2010 | Lundberg | |

(Continued)

*Primary Examiner* — Shawn M Braden

(74) *Attorney, Agent, or Firm* — McHale & Slavin, P.A.

(57) ABSTRACT

A modular drinking container configured to receive one or more components. The modular drinking container, or mug, is configured to have at least one interchangeable component, wherein the at least one interchangeable component is configured to receive and hold one or more external accessory components. The modular drinking mug comprises a removable outer member and an inner member. The inner member is configured to receive and store a liquid therein. The outer member is configured to be positioned over the inner member and secured thereto. The outer member contains one or more locking members to provide a mechanism to secure one or more external accessories to the modular drinking container.

20 Claims, 18 Drawing Sheets

(56) References Cited

U.S. PATENT DOCUMENTS

| | | | | |
|---|---|---|---|---|
| D628,442 | S | 12/2010 | Lundberg | |
| 8,312,668 | B2 | 11/2012 | Kincel | |
| 8,752,320 | B2 | 6/2014 | Masters | |
| 8,910,408 | B2 | 12/2014 | Masters et al. | |
| 9,103,625 | B2 | 8/2015 | Masters | |
| 9,157,696 | B2 | 10/2015 | Dextraze | |
| 9,239,209 | B2 | 1/2016 | Mayberry et al. | |
| 9,239,210 | B2 | 1/2016 | Mayberry et al. | |
| 9,526,364 | B1 * | 12/2016 | Lovison | A47G 23/0216 |
| 9,605,894 | B2 * | 3/2017 | Christian | F25D 31/008 |
| 2014/0231492 | A1 * | 8/2014 | Saeki | H05K 3/3436 228/180.22 |
| 2015/0219422 | A1 | 8/2015 | Kincel | |
| 2016/0022069 | A1 * | 1/2016 | Martin | B65D 25/2811 206/459.5 |
| 2016/0091277 | A1 | 3/2016 | Mayberry et al. | |

* cited by examiner

MODULAR DRINKING CONTAINER WITH SURFACE FOR ATTACHING COMPONENTS THERETO

CROSS-REFERENCE

In accordance with 37 C.F.R. 1.76, a claim of priority is included in an Application Data Sheet filed concurrently herewith. Accordingly, the present invention claims priority to U.S. Provisional Patent Application No. 62/373,112, entitled "MODULAR DRINKING CONTAINER WITH SURFACE FOR ATTACHING COMPONENTS THERETO", filed on Aug. 10, 2016. The contents of the above referenced application is herein incorporated by reference in its entirety.

FIELD OF THE INVENTION

The present invention is related to a container for holding liquids, to a container for holding liquids that contains multiple components, and more particularly, to a modular drinking mug having an outer surface having one or more securing members configured to receive and secure external attachments.

BACKGROUND OF THE INVENTION

Drinking containers are known in the art. Typically, a drinking container, such as a mug, contains a partially enclosed member designed to hold liquid therein at one end (closed end), while allowing a user the capability to obtain liquid stored therein at another end (open end). The external surface of a drinking container may function to provide an aesthetic look or feel. As such, the external surface tends to be decorated in one or more colors, patterns, corporate logos, team mascots, or the like.

SUMMARY OF THE INVENTION

The present invention is directed toward a drinking container, such as a mug, having at least one interchangeable component. In an illustrative embodiment, the drinking container contains a removable outer member and an inner member. The inner member is configured to receive and store a liquid therein. The outer member is configured to be positioned over the inner member and secured thereto, and to receive external accessories. In this manner, the outer member is interchangeable, as a user simply removes an outer member already secured to the inner member and replaces the first outer member with a second outer member.

In one embodiment, the modular drinking container may comprise an inner member having a diameter, the inner member having an internal region configured to receive and store a material therein; and an interchangeable outer member having a diameter, the outer member diameter being greater than the diameter of the inner member, wherein the outer member is positioned over the inner member and secured thereto, said outer member further comprising one or more external accessory receiving members configured to receive and secure one or more external attachments or accessory components. The modular drinking container may also include a base structure.

In another embodiment, the modular drinking container may comprise an inner member having a first open end, a second closed end, and an inner member main body therebetween, the inner member main body having an internal region configured to receive and store a material therein; an interchangeable outer member having first open end, a second open end, and an outer member main body therebetween, the outer member main body having a diameter that is greater than a diameter of the inner member, wherein the outer member is coaxially aligned with the inner member and secured thereto, the outer member further comprising one or more external accessory receiving members configured to receive and secure one or more external attachments; and a pedestal comprising at least one surface configured to receive at least a portion of the inner member and at least one surface for receiving the outer member.

In another illustrative embodiment, a modular drinking container kit comprises at least one inner member having a diameter, the inner member having an internal region and configured to receive and store a material therein; a plurality of interchangeable outer sleeve members, each having an outer surface having one or more external accessory receiving members configured for securing one or more accessory items, each outer member having a diameter that is greater than the diameter of at least one inner member; and one or more pedestals. The modular kit may include at least two interchangeable outer sleeve members having different external accessory receiving members.

Accordingly, it is an objective of the invention to provide an enhanced drinking container.

It is a further objective of the invention to provide a drinking container having one or more interchangeable components.

It is yet another objective of the invention to provide a modular drinking mug.

It is a still further objective of the invention to provide a modular drinking mug having one or more interchangeable components.

It is a further objective of the invention to provide a modular drinking mug having an outer surface configured to hold one or more external accessories.

It is yet another objective of the invention to provide a modular drinking mug having one or more interchangeable components, and having an outer surface configured to hold one or more external accessories.

It is a still further objective of the invention to provide a kit for a modular drinking mug, wherein the kit contains at least one interchangeable component.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
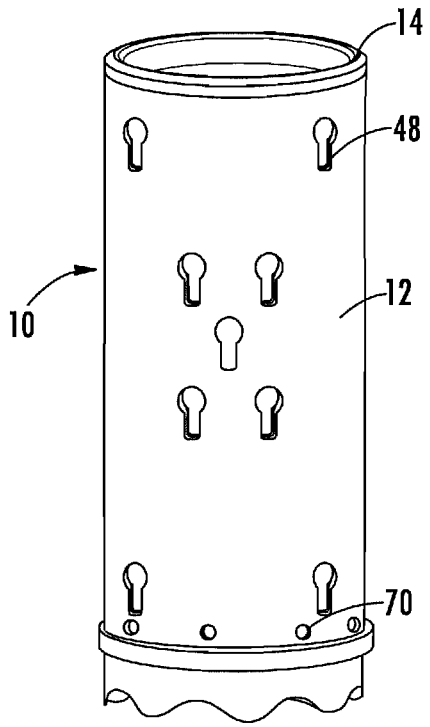
FIG. 1 is a perspective view of an illustrative embodiment of a modular drinking container having an outer surface configured to hold one or more external accessories.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
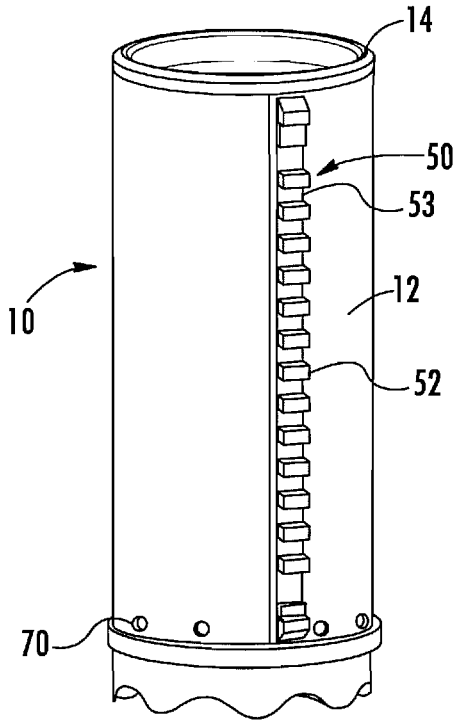
FIG. 2 is a perspective view of the modular drinking container having an outer surface configured to hold one or more external accessories illustrated in FIG. 1, shown having an alternative outer surface member.
Figure 3:
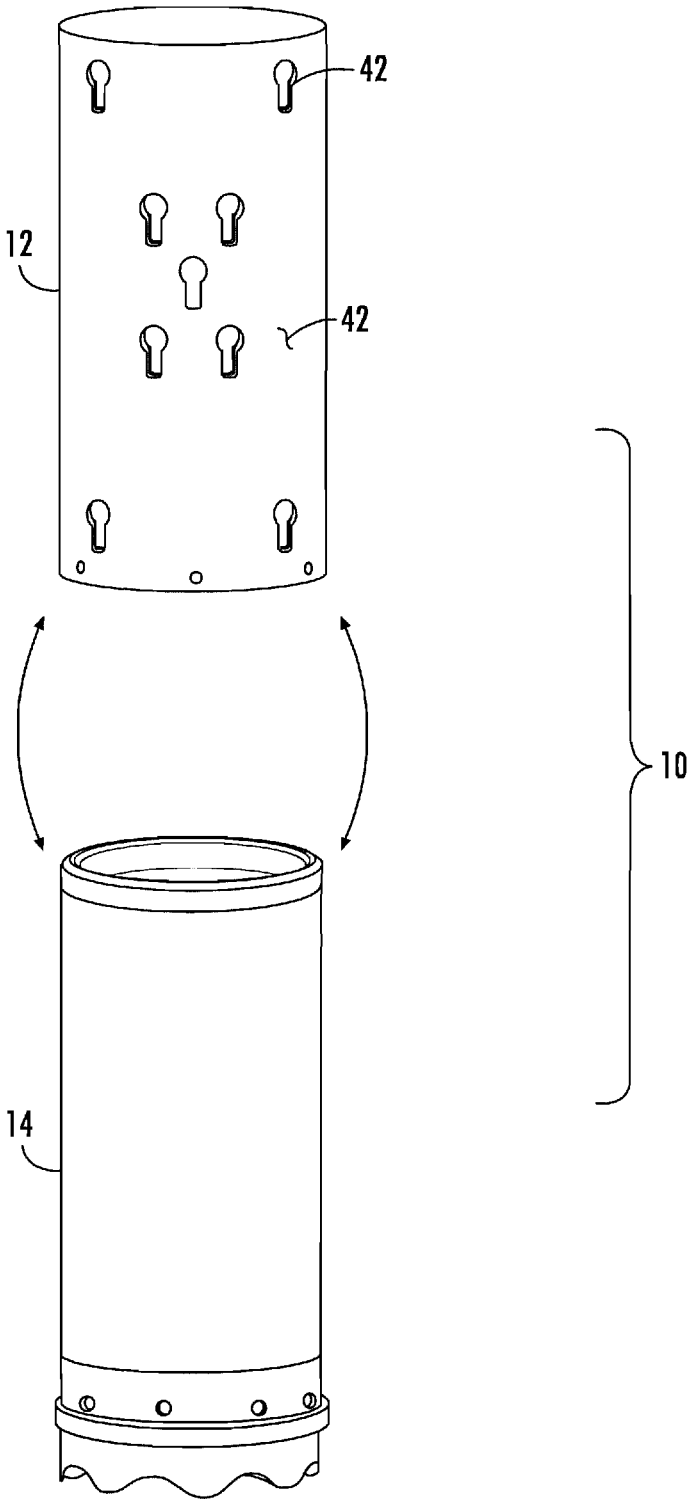
FIG. 3 is an exploded view of the modular drinking container having an outer surface configured to hold one or more external accessories.

Referring to FIGS. 1-3, an illustrative example of a drinking container configured to receive one or more components, referred to generally as a modular drinking mug 10, is illustrated. The modular drinking mug 10 is configured to have at least one interchangeable component, wherein the at least one interchangeable component is configured to receive and hold one or more external accessory components. The modular drinking mug 10 comprises a removable outer member 12 and an inner member 14. The inner member 14 is configured to receive and store a liquid therein. The outer member 12 is configured to be positioned over the inner member 14 and secured thereto. In this manner, the outer member 12 is interchangeable, as a user simply removes an outer member already secured to the inner member and replaces the first outer member with a second outer member. The outer member 12 may be made of any material, including metals or plastics. Preferably, the outer member is made of an anodized aluminum or carbon fiber material. While the inner member 14 may be made of any material, it is preferable that it is made of a plastic polymer or insulated foam.

Figure 4:
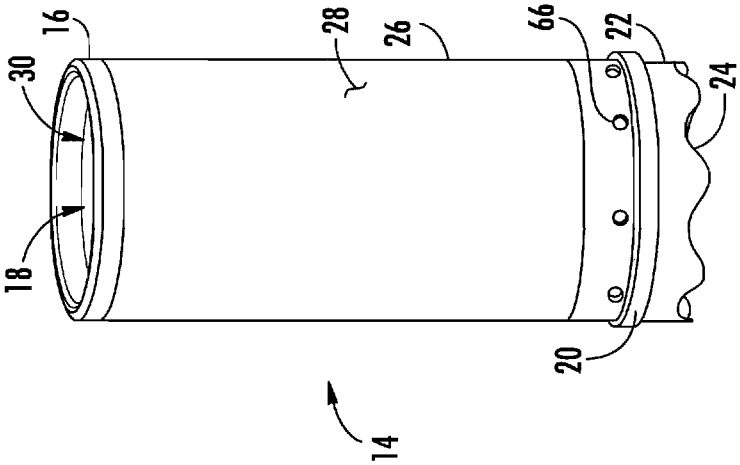
FIG. 4 is a perspective view of an inner member of the modular drinking container having an outer surface configured to hold one or more external components.

Referring to FIG. 4, an illustrative example of the inner member 14 is shown. The inner member 14 contains a first end 16 having an opening 18, and a closed, opposing second end 20. At the closed second end 20 is a base or support structure, illustrated as a pedestal 22, terminating in a scalloped or crenelated surface 24. The scalloped or crenelated surface 24 is shown containing one or more concave and convex surfaces. Other shapes, however, may be utilized. Separating the first end 16 and the second end 20 is a body 26, illustrated herein as an elongated cylindrical body, providing an external surface 28 of the inner member 14. The inner member body 26 contains an inner lumen 30 for receiving and holding a liquid.

Figure 5B:
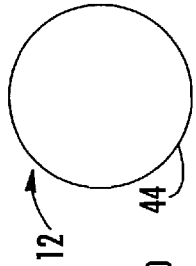
FIG. 5B is a top view of the outer member of the modular drinking container having an outer surface configured to hold one or more external components.
Figure 5C:
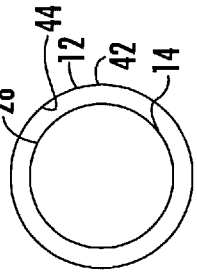
FIG. 5C is a top view of the modular drinking container.
Figure 5A:
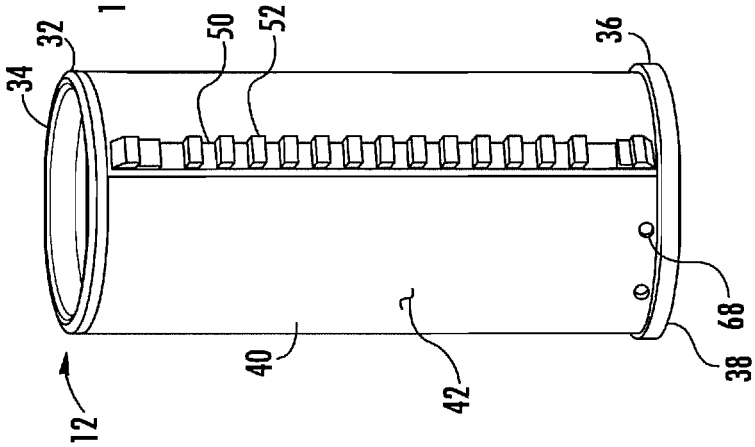
FIG. 5A is a perspective view of an outer member of the modular drinking container having an outer surface configured to hold one or more external components.
Figure 7:
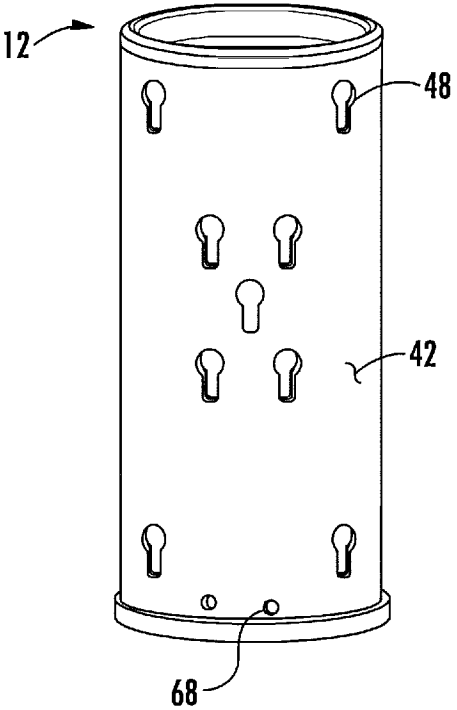
FIG. 7 is a perspective view of the outer member of the modular drinking container having an outer surface configured to hold one or more external accessories illustrated in FIG. 1, shown having an alternative outer surface member.
Figure 6:
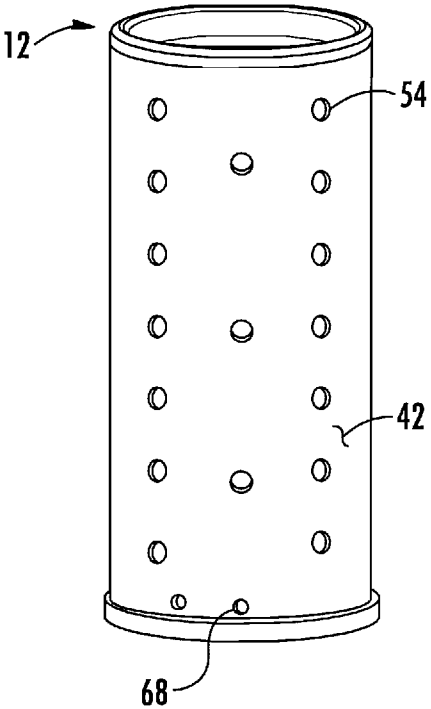
FIG. 6 is a perspective view of the outer member of the modular drinking container having an outer surface configured to hold one or more external accessories illustrated in FIG. 1, shown having an alternative outer surface member.

Referring to FIG. 5A, an illustrative example of the outer member 12 is shown. The outer member 12 contains a first end 32 having an opening 34, an opposing second end 36 having an opening 38, and an outer member body 40 therebetween. The outer member body 40 has an outer surface 42 and an inner surface 44 (see FIG. 5B). When secured to the inner member 14, the inner surface 44 of the outer member 12 is adjacent, or preferably, in coaxial alignment with the external surface 28 of the inner member 14, see FIG. 5C. The outer member 12 contains one or more securing members configured to receive and secure external attachments. As shown in FIG. 1 and FIG. 7, the securing members include one or more key-hole apertures 48. The key-hole apertures 48 are sized and shaped to receive and hold a corresponding key-hole locking member or key (not shown) associated with an external component/accessory (to be illustrated later). In this arrangement, the external accessory can be placed on the surface 42 in any area where there are corresponding key-hole apertures 48 and locked in place, thereby securing the accessory to the modular drinking mug 10. FIG. 2 and FIG. 5A illustrate an alternative locking member, illustrated as a locking rail 50. The locking rail 50 contains a plurality of locking rails 52 and slots 53 designed to engage and lock with corresponding structures placed on an external accessory. FIG. 6 illustrates another embodiment of the securing members, illustrated herein as circular openings 54. The circular openings 54 are sized and shaped to receive corresponding circular knobbed structures (not shown) which fit together through, for example, a frictional or snap fit.

Figure 8:
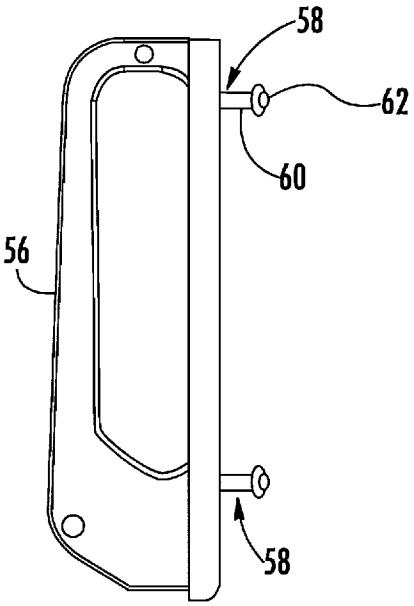
FIG. 8 is a perspective view of an illustrative example of an external accessory, illustrated as a modular drinking container handle.
Figure 9:
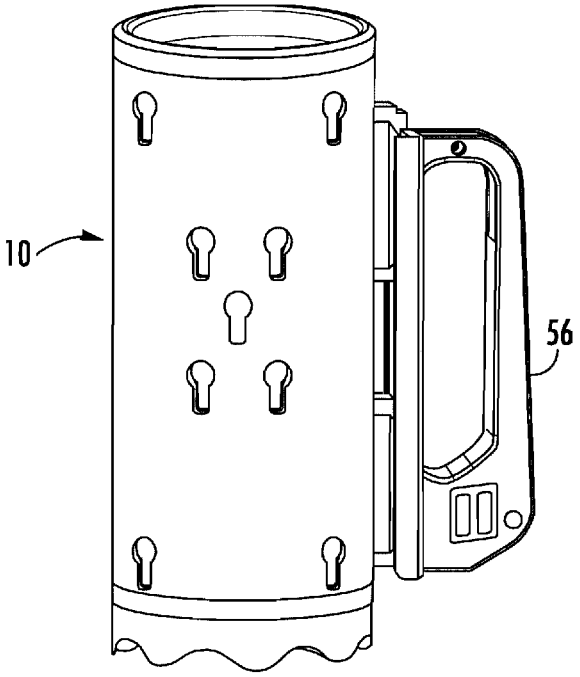
FIG. 9 is a perspective view of the outer member of the modular drinking container having an external accessory attached thereto.
Figure 10:
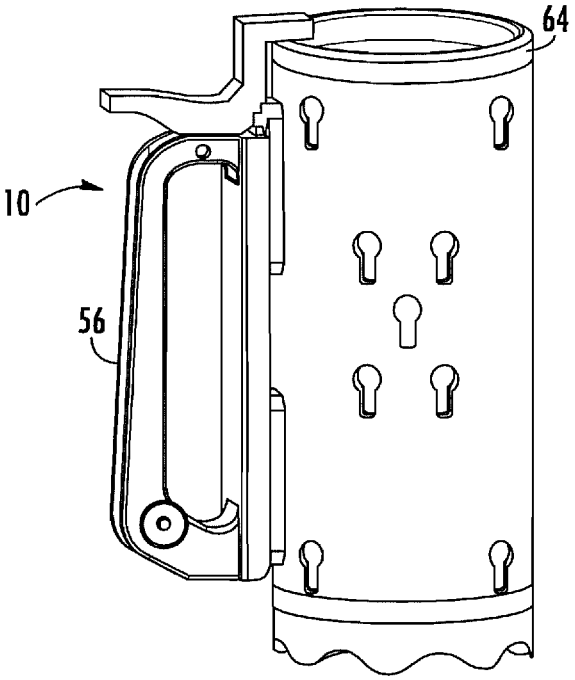
FIG. 10 is a perspective view of the outer member of the modular drinking container having an external accessory attached thereto.

FIG. 8 illustrates an example of an external accessory, shown as a handle 56. The handle 56 has a pair of external accessory locking units 58. The external accessory locking units 58 contain an elongated bar 60 extending from the handle and terminating in a rounded or ball-like member 62. As an illustrative example, the rounded or ball-like member 62 may be inserted into a circular opening 54 or the key-hole aperture to secure the handle 56 to the modular drinking mug 10. FIG. 9 shows the handle 56 attached to the modular drinking mug 10. FIG. 1*p* illustrates a handle 56 with a lid 64 to cover the opening 18 of the inner member 14.

The configuration of the modular drinking mug 10 allows the user to quickly and easily interchange the outer sleeve member 12 with other outer sleeve members having different locking mechanisms. One or more securing openings 66 located on the inner member 14 overlap with a second set of securing members 68 located the outer member 12 to allow a securing mechanism, such as a screw 70 (see FIGS. 1 and 2), to secure both components together. Alternatively, both the inner member 14 and the outer member 12 may contain corresponding interrupted screws and threading (a screw that has a section of thread along its axis removed, mated with partially threaded area, so that where the screw has thread, the partially threaded area does not, and vice versa) so that the outer member 12 can be placed over the inner member 14 and rotated, thereby securing the two components together.

Figure 11A:
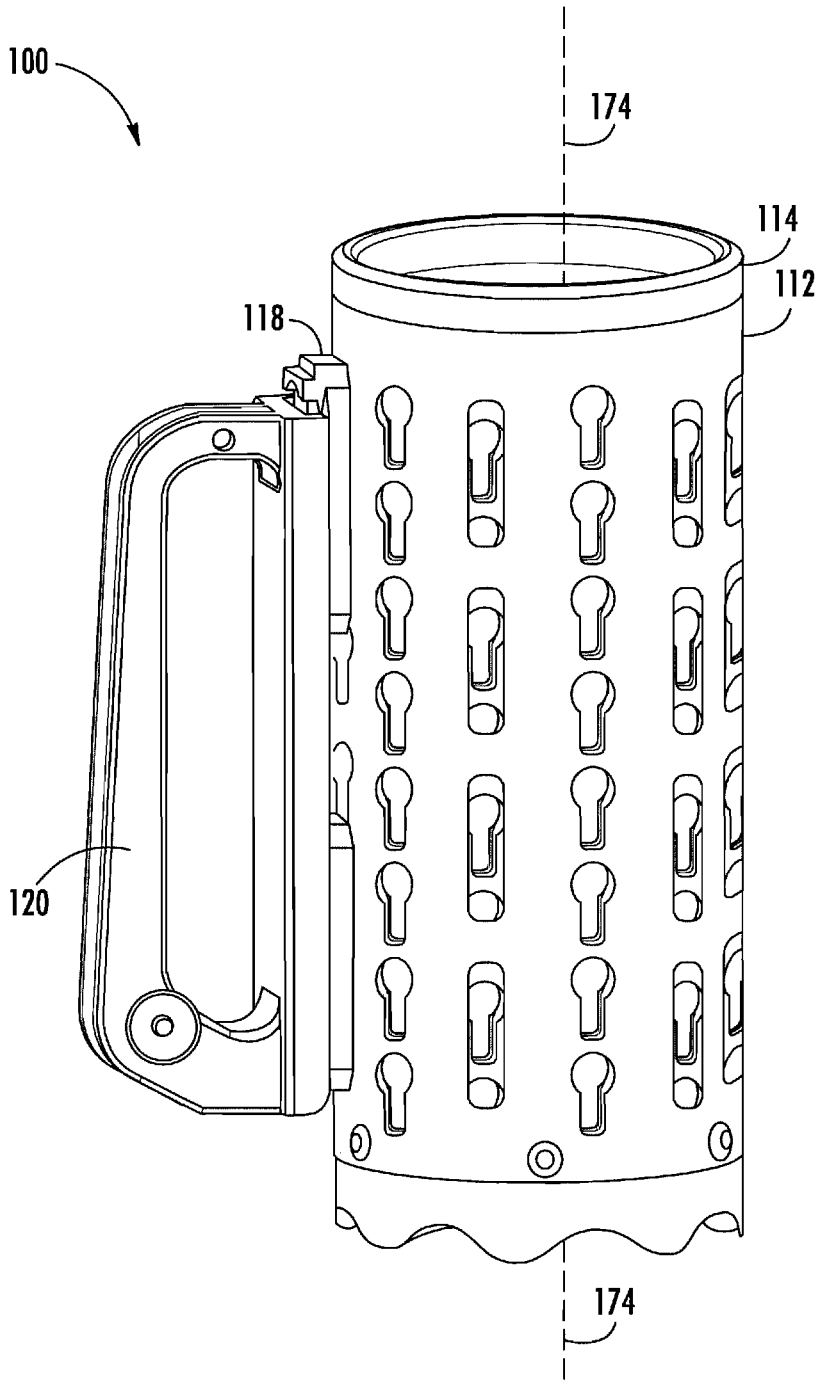
FIG. 11A is a perspective view of an illustrative embodiment of a modular drinking container having an outer surface configured to hold one or more external accessories.

Referring to FIGS. 11A-19, an illustrative example of a drinking container configured to receive one or more components, referred to generally as a modular drinking mug 100, is illustrated. The modular drinking mug 100 is configured to have at least one interchangeable component, wherein the at least one interchangeable component is configured to receive and hold one or more external accessory components. The modular drinking mug 100 comprises a removable outer member 112 and an inner member 114. The inner member 114 is configured to receive and store a liquid therein. The outer member 112 is configured to be positioned over the inner member 114 and secured thereto. In this manner, the outer member 112 is interchangeable; as a user simply removes an outer member 112 already secured to the inner member and replaces the first outer member with a second outer member. The outer member 112 may be made of any material, including metals or plastics; preferably, it is made of an anodized aluminum or carbon fiber material. While the inner member 114 may be made of any material, it is preferable that it is made of a plastic polymer or insulated foam. The outer member 112 remains in place through securing to a base or support structure, illustrated as a pedestal 116, to the inner member 114. As illustrated in FIG. 11A, the outer member 112 is configured to receive and hold one or more external accessory component securing members or mounting brackets, illustrated herein as a rail mount system 118. The rail mount system 118 is configured to receive and hold additional external accessory components, such as a handle 120, see FIG. 12.

The inner member 114 contains a first end 122 having an opening 124 (FIG. 14), a closed, opposing second end 126, and a main body 128 therebetween. The inner member main body 128 comprises a diameter 127. While the main body 128 is illustrated as having a generally circular cross section, other shapes may be used. As such, the use of the term "diameter" herein may be defined as the length of a straight line passing from side to side through the center of an object, body or figure. The first end 122 of the inner member 114 contains a lip 130 which extends around the circumference of the main body 128. The lip 130 extends outward, away from the main body 128. A bottom surface 132 of the lip 130 provides a mechanism to secure at least a portion of the outer member 112 thereto. The opening 124 is sized and shaped to allow, for example, a liquid to be placed into and stored within the interior 134 of the main body 128. The bottom surface 136 of the inner member 114 contains one or more inner member locking members 137 constructed and arranged to lock the inner member 114 to the pedestal 116. The inner member locking members 137 are illustrated as two tabs 138 having a cylindrical post 140 extending out from the bottom surface 136 of the inner member and terminating in a rounded upper top portion 142 that has a larger circumference than the circumference of the cylindrical post 140.

Figure 12:
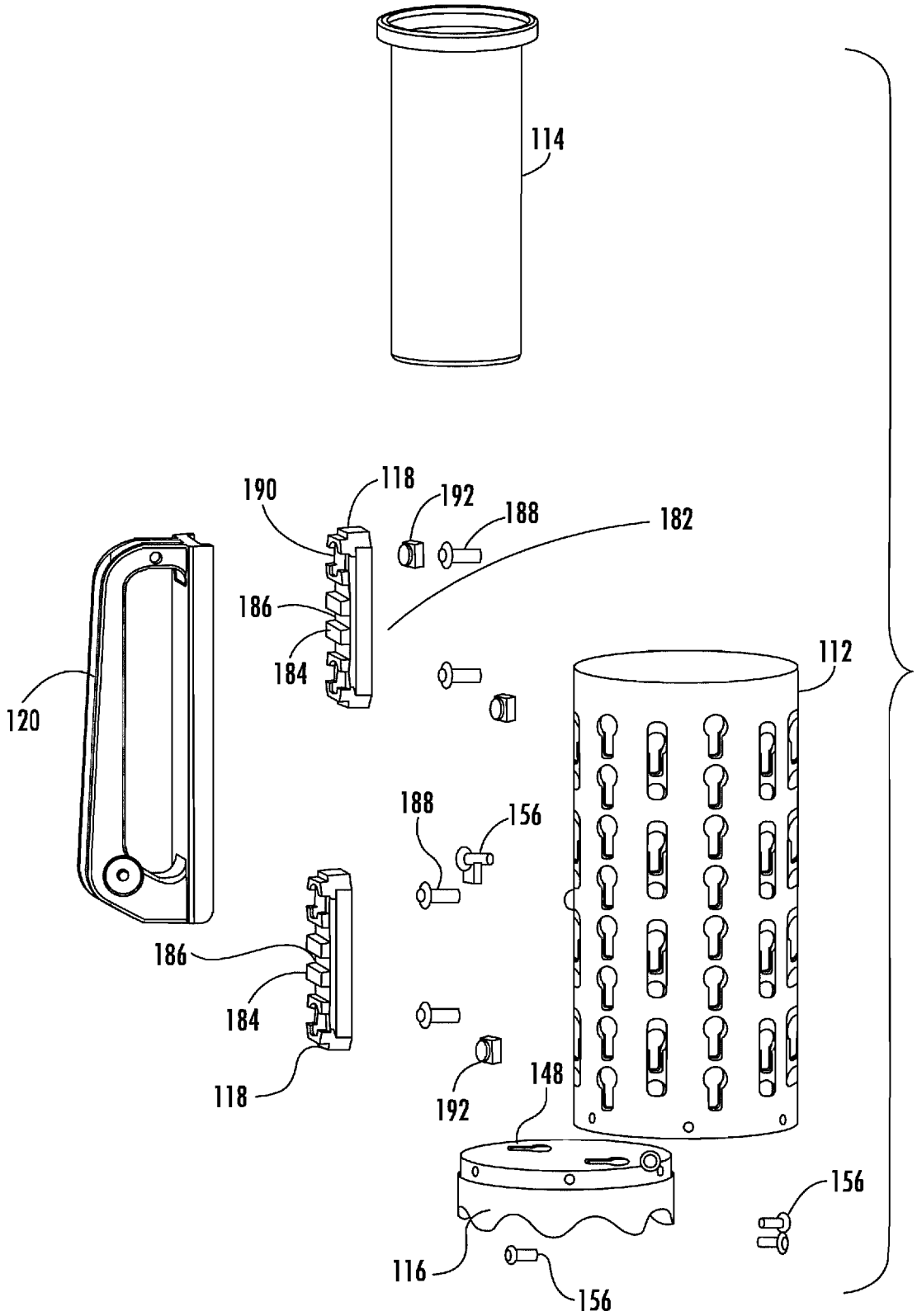
FIG. 12 is an exploded view of the modular drinking container having an outer surface configured to hold one or more external accessories illustrated in FIG. 11A.
Figure 13:
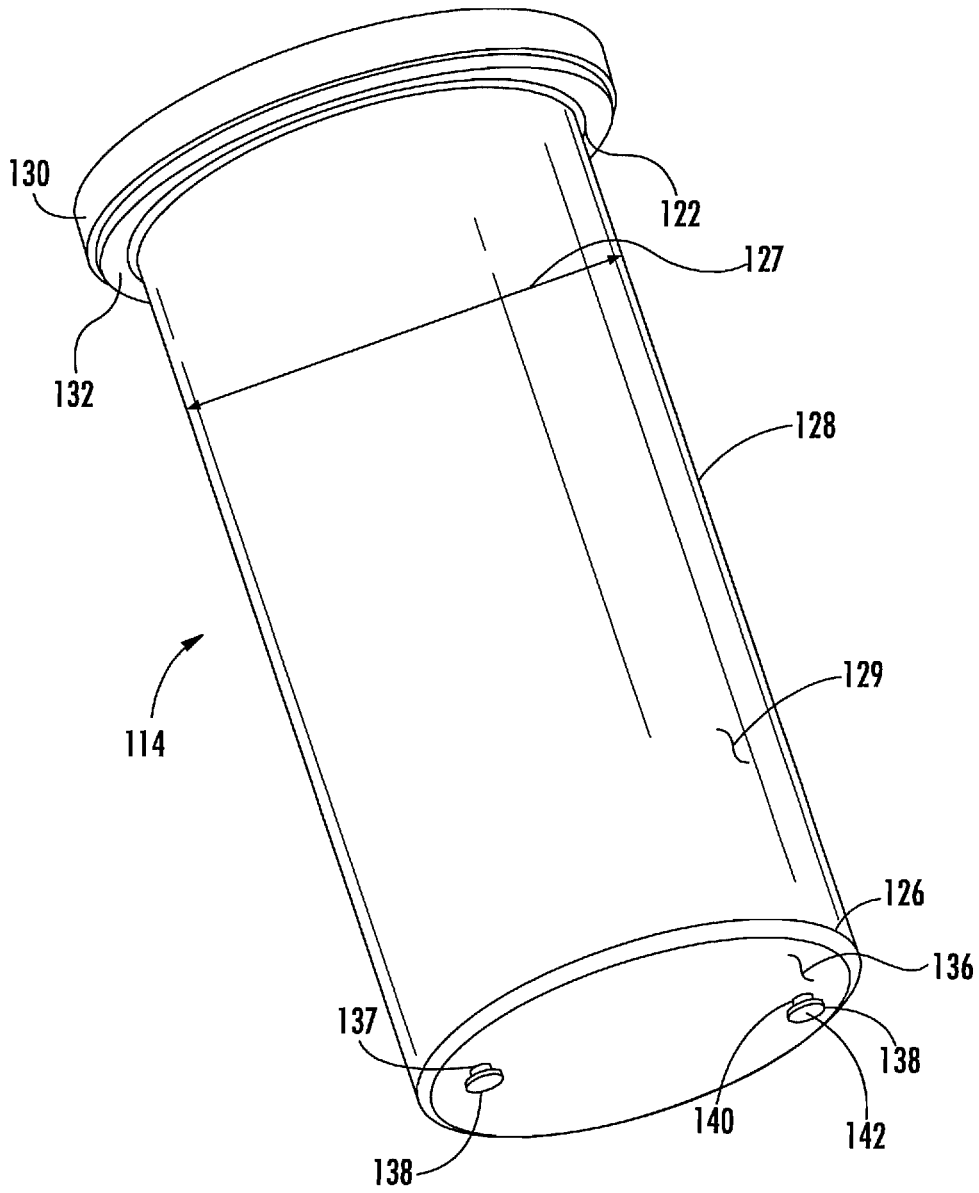
FIG. 13 is an illustrative perspective view of the inner member of the modular drinking container illustrated in FIG. 11A.
Figure 14:
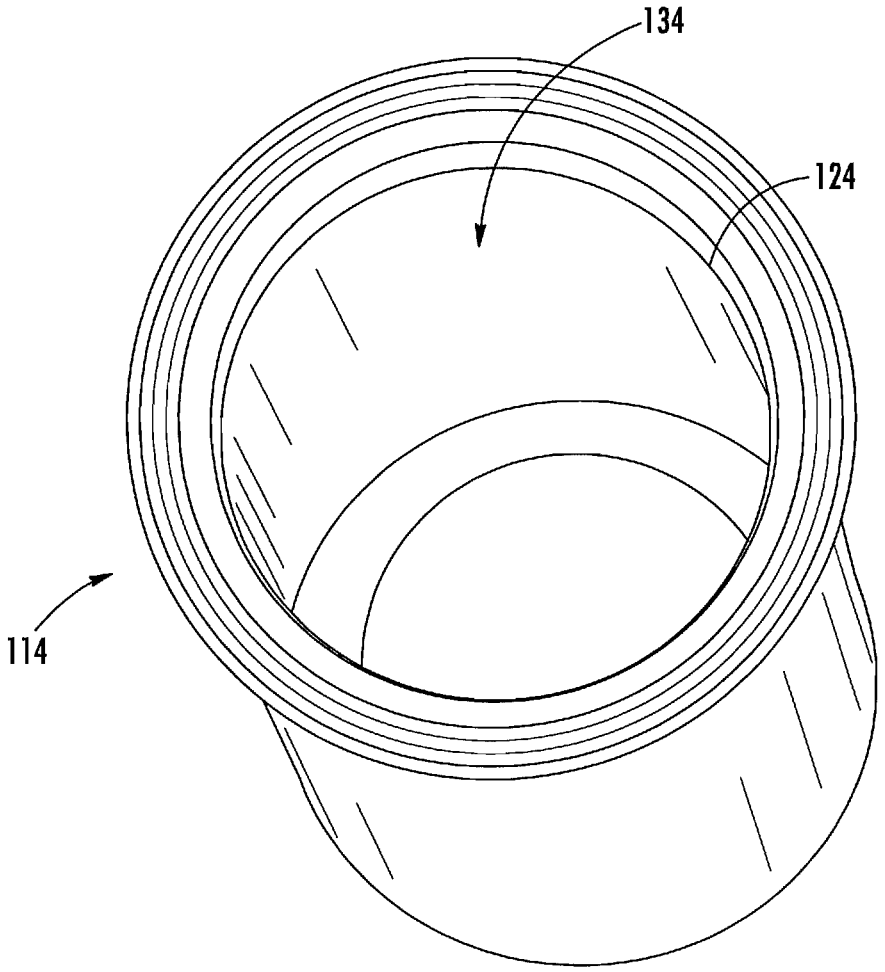
FIG. 14 is a top perspective view of the inner member of the modular drinking container illustrated in FIG. 13.
Figure 18:
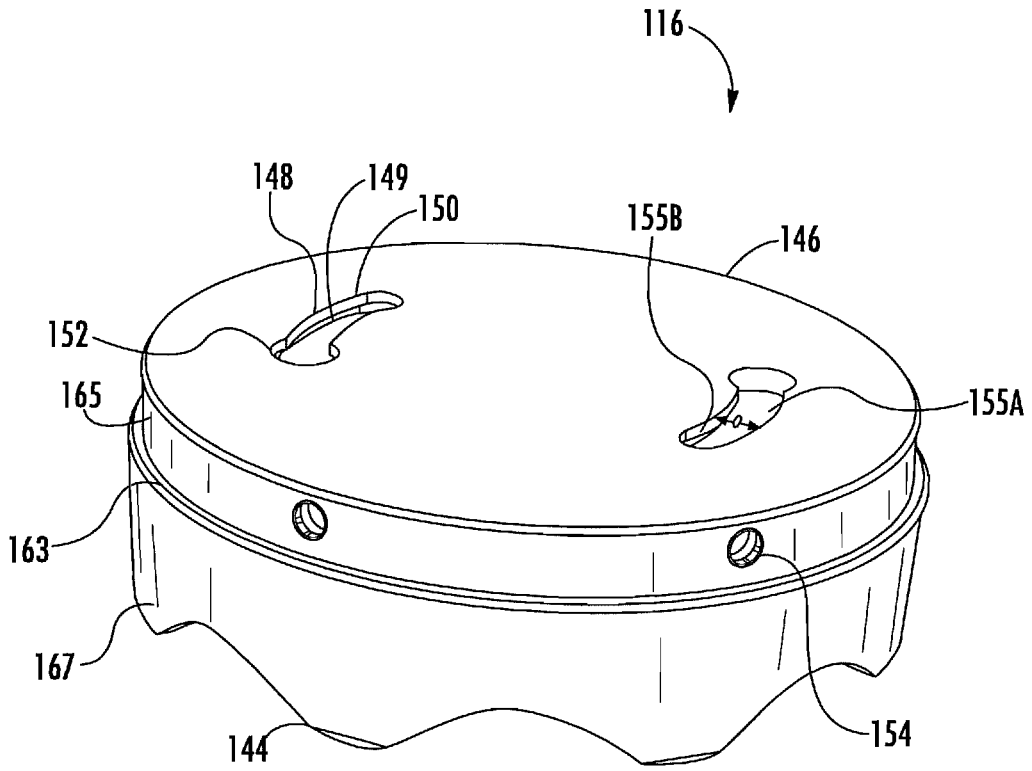
FIG. 18 is a perspective view of an illustrative pedestal of the modular drinking container illustrated in FIG. 11A.
Figure 19:
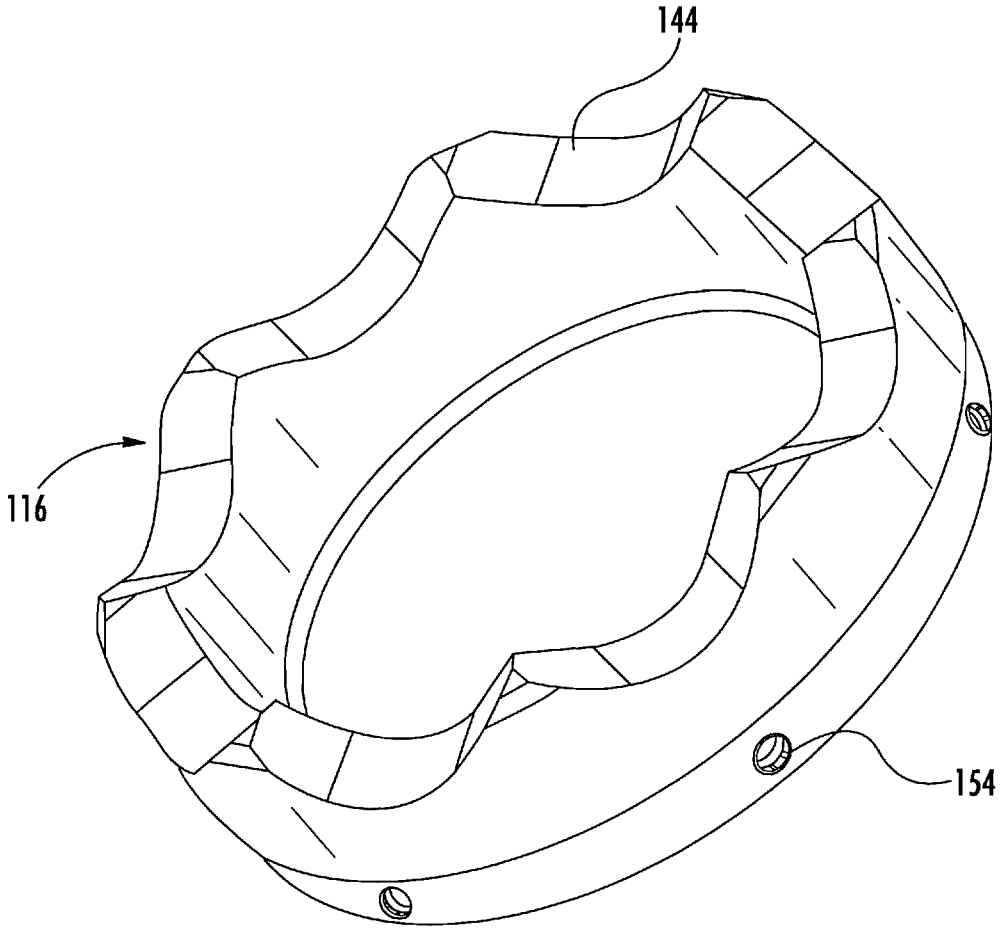
FIG. 19 is a bottom perspective view of the illustrative pedestal of the modular drinking container illustrated in FIG. 18.

The pedestal 116 is shown having a scalloped or crenelated surface 144. The scalloped or crenelated surface 144, see FIGS. 12, 18, and 19, is shown containing one or more concave and convex surfaces. Other shapes, however, may be utilized. The upper surface 146 contains one or more inner member receiving members 148 constructed and arranged to receive and hold the inner member locking members 137. As illustrated in FIGS. 12 and 18, the inner member receiving member 148 is a slotted region 149 containing a body 150 terminating in a partial circular top or head 152. The head 152 is sized and shaped to receive the rounded upper top portion 142 of the inner locking member 138. The body 150 is sized and shaped to maintain the inner locking member cylindrical post 140 therein. In use, a user places the inner member locking member 138 into the inner member receiving member 148, and slides the inner member locking member 138 along the length of the inner member receiving member 148 to lock in place. The distance, D, between the walls 155A and 155B is smaller than the circumference of the rounded upper top portion 142 of the inner locking member to ensure proper locking. The pedestal 116 may also contain a plurality of openings 154 sized and shaped to receive one or more screws 156 (see FIG. 12) for securing the outer member 112 in place. When secured in place, the bottom edge 161 of the outer member 112 rests upon shoulder 163 of the pedestal 116. The shoulder 163 extends around the perimeter of the pedestal 116, creating a smaller diameter member 165 and a larger diameter member 167.

Figure 11B:
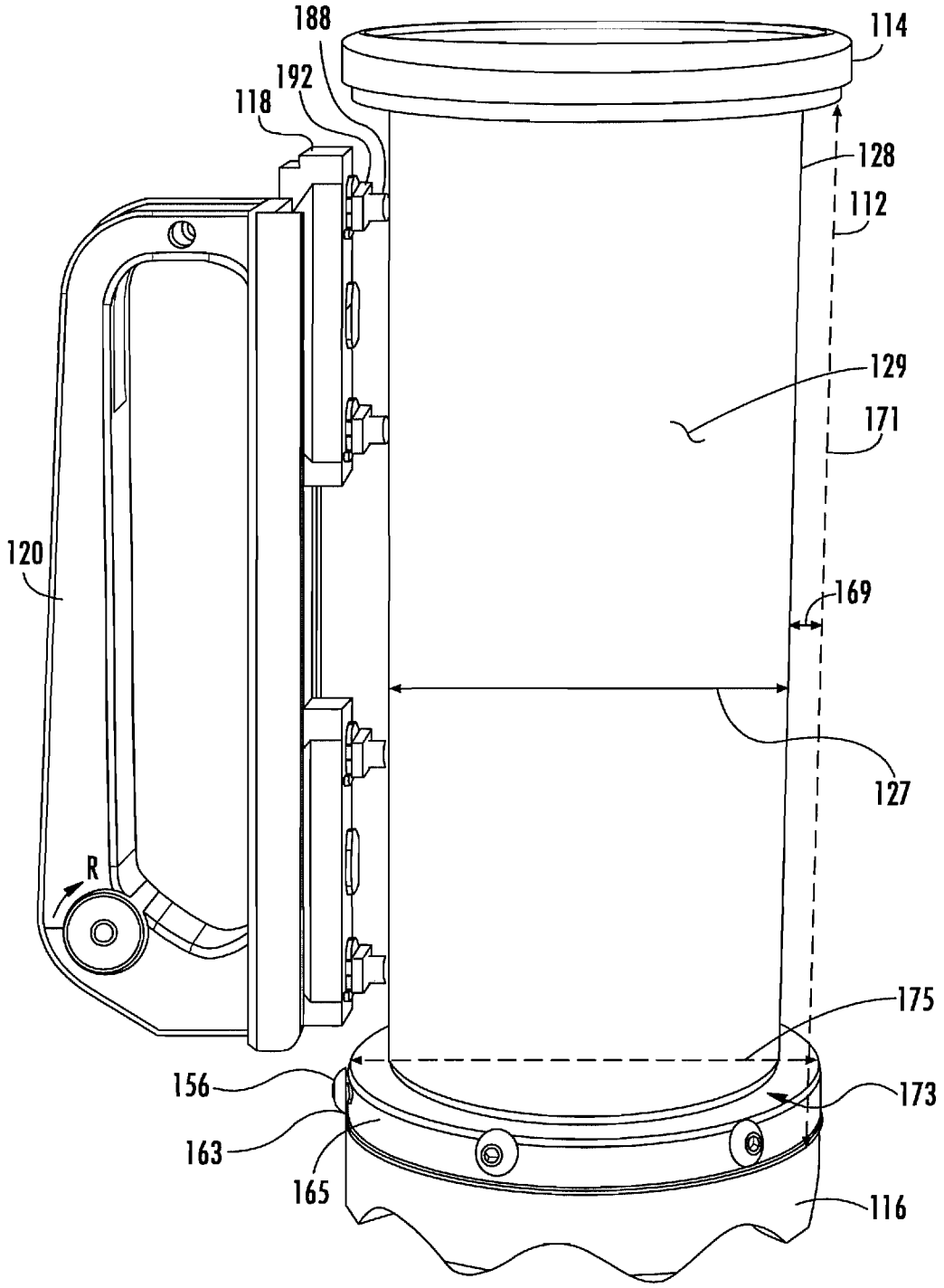
FIG. 11B is a perspective view of the modular drinking container shown in FIG. 11A, with the outer member removed.

FIG. 11B illustrates the modular drinking mug 100 shown in FIG. 11A with the outer member 112 removed. The dashed line located on the right side indicates the location or position of the outer member 112 if shown. As illustrated, there is a space or gap 169 between the outer surface 129 of the inner member 114 and the inner surface 171 of the outer member 112. This space or gap 169 has a length sufficient to allow one or more portions of an external component/accessory component to fit or rest within. FIG. 11B further illustrates the possible positioning of the inner member main body 128 relative to the pedestal 116. As shown, inner member main body 128 is supported by a pedestal surface 173 of the smaller diameter member 165. As an illustrative example, the inner member main body diameter 127 is smaller than a diameter 175 (solid and dashed line) of the smaller diameter member 165.

Figure 15:
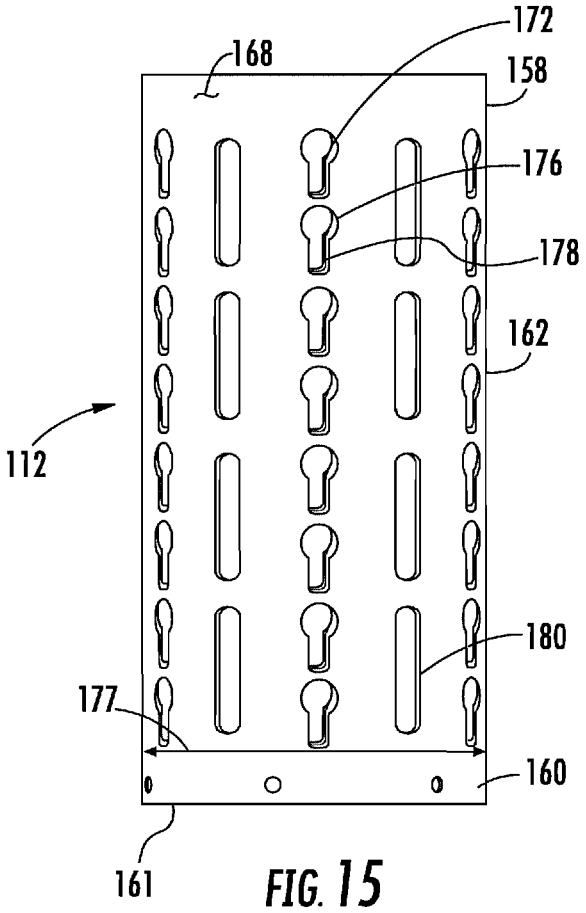
FIG. 15 is a side view of the outer member of the modular drinking container illustrated in FIG. 11A.
Figure 16:
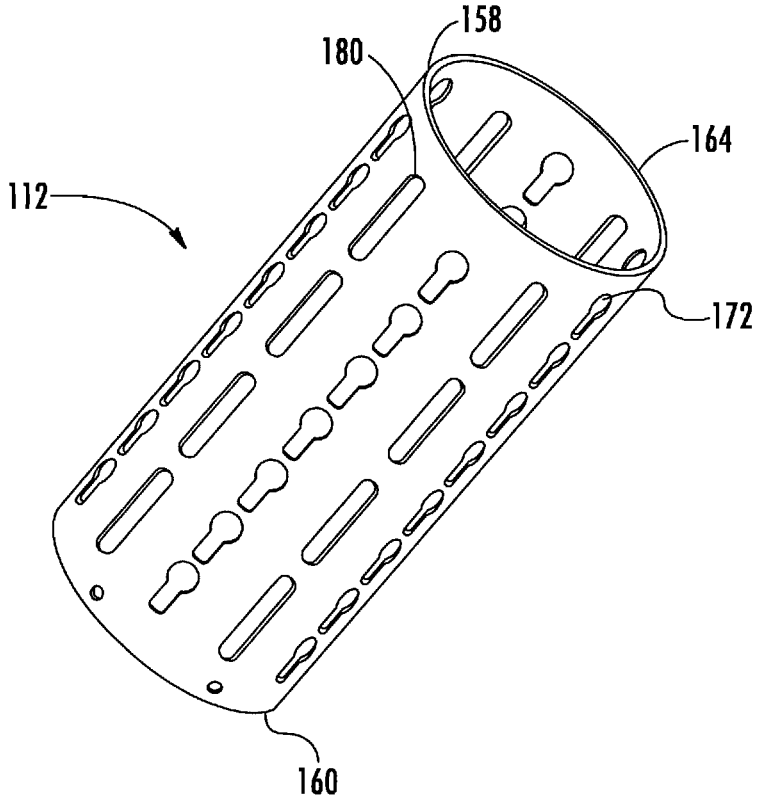
FIG. 16 is a front perspective view of the outer member of the modular drinking container illustrated in FIG. 15.
Figure 17:
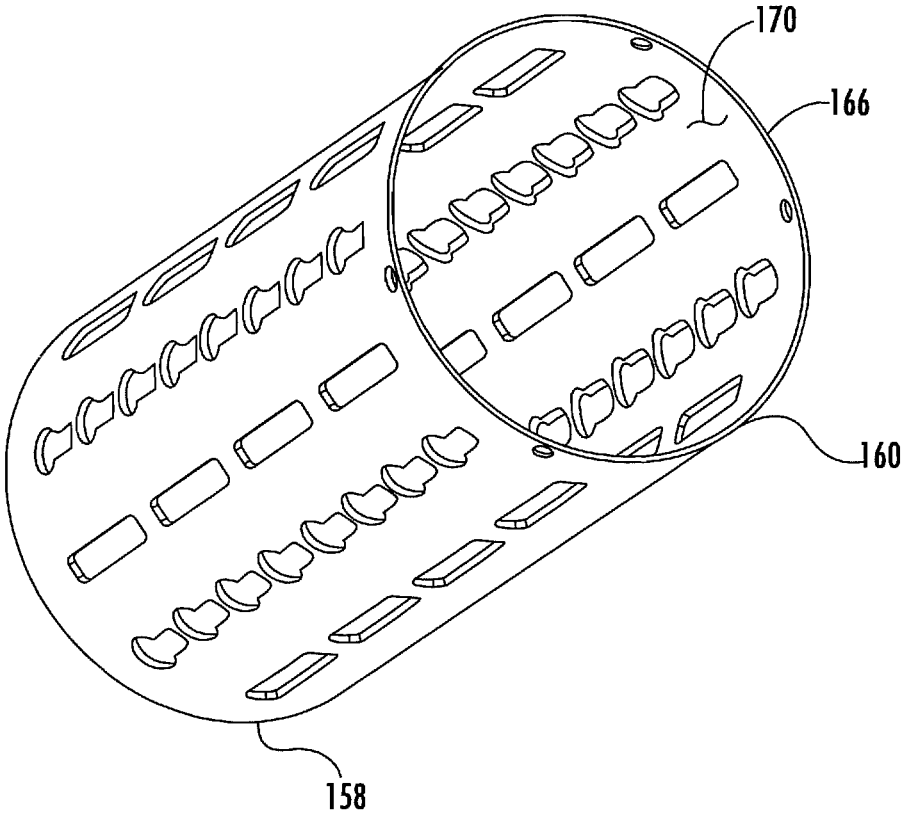
FIG. 17 is a bottom perspective view of the outer member of the modular drinking container illustrated in FIG. 15.

Referring to FIGS. 15-17, the outer member 112 is shown. The outer member 112 contains a first end 158, a second opposing end 160, and a body 162. The body 162 has a diameter 177. Preferably, the diameter 177 of the outer member body 162 is larger than the diameter 127 of the inner member main body 128. The first end contains an opening 164. The opposing second end 160 has an opening 166. The outer member body 162 has an outer surface 168 (see FIG. 15) and an inner surface 170 (see FIG. 17). When secured to the inner member 114, the inner surface 170 of the outer member 112 is adjacent, or preferably, in a coaxial alignment with the external surface 129 of the inner member 114. The outer member 112 contains one or more external accessory receiving members configured to receive and secure external attachments. The one or more external accessory receiving members include one or more key-hole apertures 172. The key-hole apertures 172 are sized and shaped to receive and hold a corresponding key-hole locking member or key (not shown) associated with an external component/accessory, such as handle 120. The key-hole apertures 172 may be aligned in rows, and are orientated parallel to the longitudinal axis 174 (see FIG. 11A) of the modular drinking mug 100. As illustrated, the key-hole apertures 172 contain a circular or arced end 176 end and a narrower oblong body 178.

The one or more external accessory receiving members may also include one or more elongated slots 180. The elongated slots may be aligned in rows, and are orientated parallel to the longitudinal axis 174 (see FIG. 11A) of the modular drinking mug 100. Both the key-hole apertures 172 and the one or more elongated slots 180 may be placed completely or partially around the circumference of the outer member 112. Both the key-hole apertures 172 and the one or more elongated slots 180 preferably extend through the outer member 112, but need not be designed in this manner.

Figure 20:
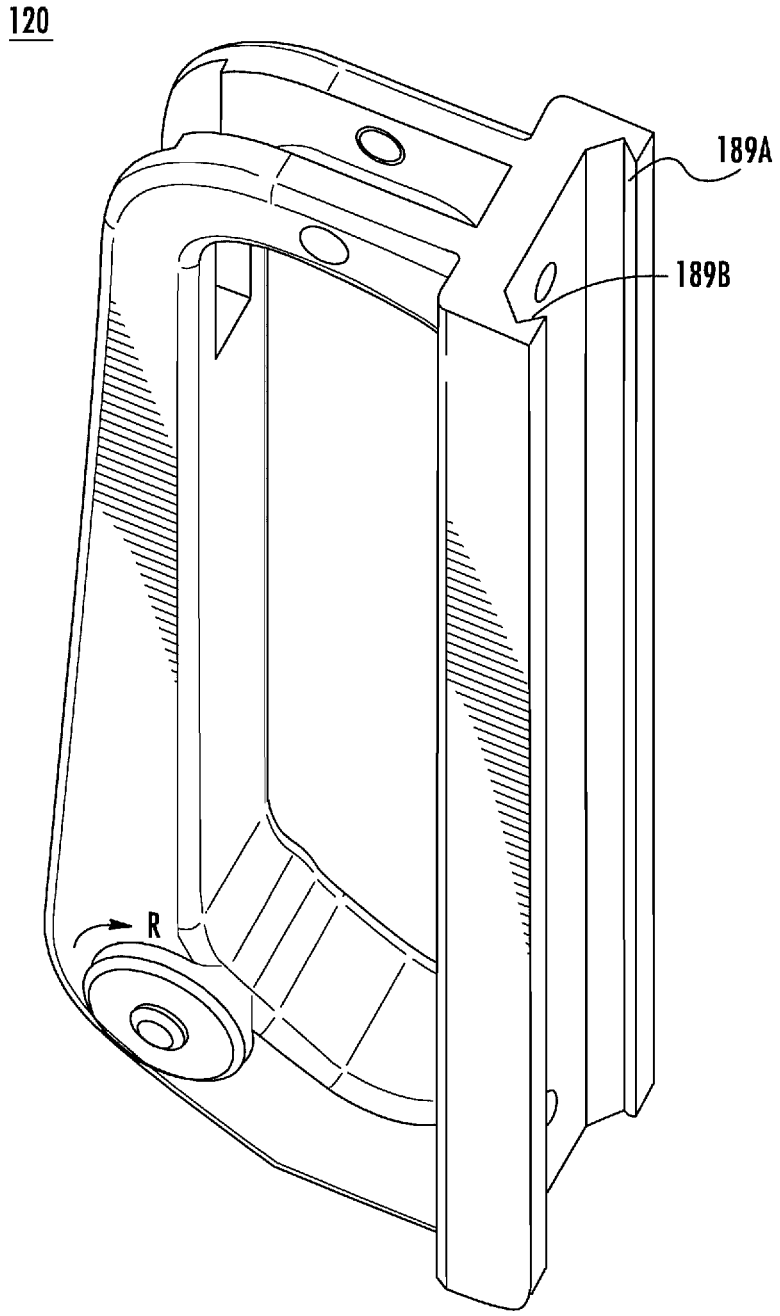
FIG. 20 is a perspective view of a handle.
Figure 21:
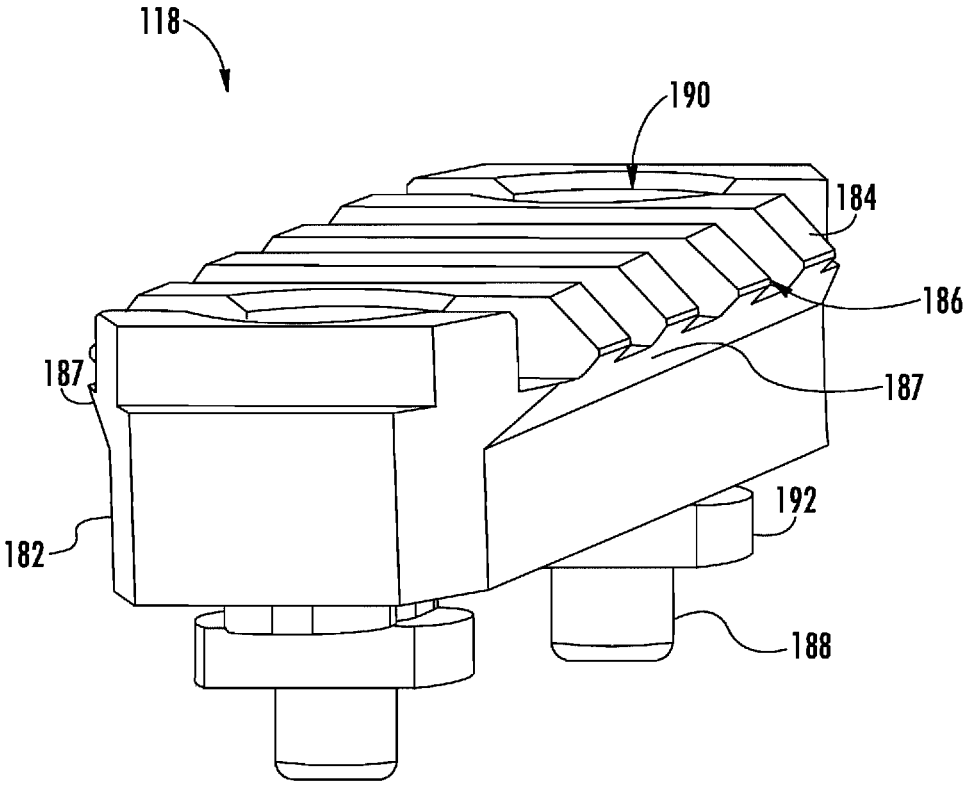
FIG. 21 is a perspective view of an illustrative rail mount.

The key-hole apertures 172 and the one or more elongated slots 180 are designed to receive external accessory components, such as a handle 120, or a flashlight (not shown) via direct coupling. Alternatively, the external accessory components may be secured to the outer member 112 using additional mounting systems. As described above, a rail mount system 118 may be secured to the elongated slots 180. Once secured to the outer member 112, an external accessory component may then be directly mounted to the rail mount system 118. Referring back to FIG. 12, the rail mount system 118 is illustrated as a picatinny rail mount containing a body 182 having a series of parallel arranged rails 184 and slots 186. A screw 188 is inserted into a bore 190. The screw 188 uses a T-nut 192 configured to rotate within the elongated slot 180 to lock or unlock in place. To secure the handle 120 to the rail mount system 118, the handle 120 may include corresponding rails and slots (not shown). The picatinny rail mount body 182 contains an angled surfaces 187 (see FIG. 21) which are sized and shaped to slideably engage and lock within corresponding angled, flanged surfaces 189A and 189B of handle 120 (see FIG. 20).

Other rail mounting systems, such as a weaver rail mount, or other non-rail mounting mechanisms known to one of skill in the art, may be used as well.

Figure 22:
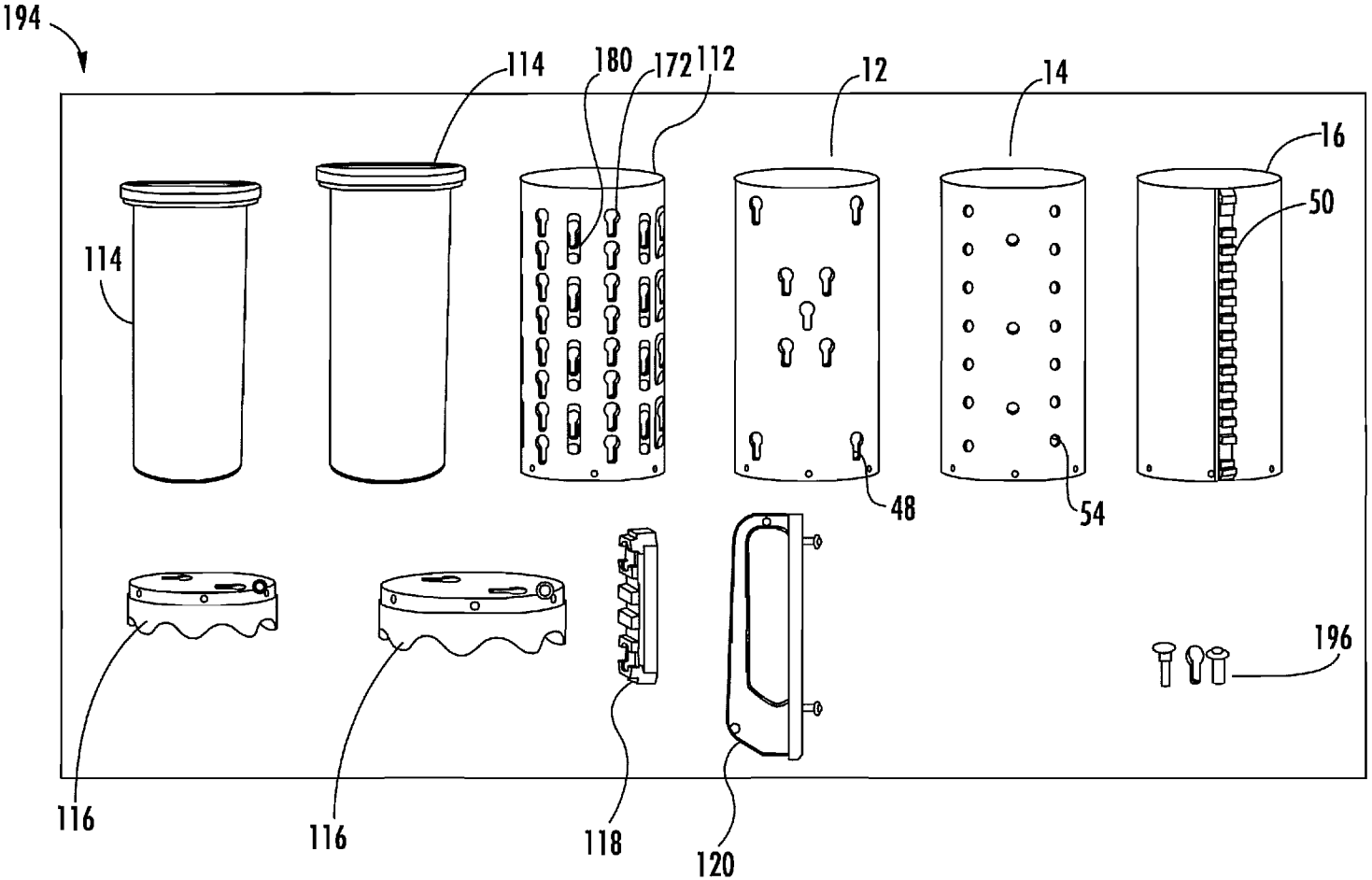
FIG. 22 is an illustrative kit including one or more components of the modular drinking container in accordance with the present invention.

FIG. 22 illustrates a kit 194 containing at least one inner member 114 and a plurality of outer sleeve members 112/12 having different locking mechanisms, such as key-hole apertures 48/172, slots 180, circular openings 54, and a locking rail system 50. The kit 194 may also contain one or more pedestals 116, a mounting rail system 118, and an external accessory, such as a handle 120. Mounting hardware, such as screws 196, may be placed in the kit 194 as well. The kit 194 may be designed to include one or more of any component (singularly or a plurality of each component) described herein.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A modular drinking container comprising:

an inner member having a diameter, said inner member having an internal region configured to receive and store a material therein; and an interchangeable outer member having a diameter, said outer member diameter being greater than said diameter of said inner member, wherein said outer member is positioned over said inner member and secured thereto, said outer member further comprising one or more external accessory receiving members comprising one or more key-hole apertures, one or more elongated slots, or combinations thereof configured to receive and secure one or more external attachments or accessory components.

2. The modular drinking container according to claim 1 further including a base structure.

3. The modular drinking container according to claim 2 wherein said base structure is secured to said inner member.

4. The modular drinking container according to claim 1 wherein said one or more external attachments or accessory components is a removable rail mount system.

5. The modular drinking container according to claim 1 wherein said one or more external attachments or accessory components is a removable handle.

6. The modular drinking container according to claim 1 wherein said outer member is made of a metal or plastic material.

7. The modular drinking container according to claim 6 wherein said outer member is made of an anodized aluminum or carbon fiber material.

8. The modular drinking container according to claim 1 wherein said inner member is made of a plastic polymer or insulated foam.

9. A modular drinking container comprising:

an inner member having a first open end, a second closed end, and an inner member main body therebetween, said inner member main body having an internal region configured to receive and store a material therein;

an interchangeable outer member having a first open end, a second open end, and an outer member main body therebetween, said outer member main body having a diameter that is greater than a diameter of said inner member, wherein said outer member is coaxially aligned with said inner member and secured thereto, said outer member further comprising one or more external accessory receiving members comprising one or more key-hole apertures, one or more elongated slots, or combinations thereof configured to receive and secure one or more external attachments; and a pedestal comprising at least one surface configured to receive at least a portion of said inner member and at least one surface for receiving said outer member.

10. The modular drinking container according to claim 9 wherein said at least one surface configured to receive at least a portion of said inner member has a larger diameter than a diameter of said inner member main body.

11. The modular drinking container according to claim 9 wherein said pedestal includes one or more inner member receiving members configured to engage with at least one portion of said inner member.

12. The modular drinking container according to claim 9 wherein said inner member comprises one or more inner member locking members configured to engage with one or more pedestal inner member receiving members.

13. The modular drinking container according to claim 9 wherein said one or more external attachments are attached to said outer member using a mount.

14. The modular drinking container according to claim 13 wherein said mount is a rail mount.

15. A modular drinking container kit comprising:

at least one inner member having a diameter, said inner member having an internal region and being configured to receive and store a material therein;

a plurality of interchangeable outer sleeve members each having an outer surface having one or more external accessory receiving members configured for securing one or more accessory items, wherein at least two interchangeable outer sleeve members of said plurality of interchangeable outer sleeve members have different external accessory receiving members, each said outer sleeve member having a diameter that is greater than said diameter of said at least one inner member; and one or more pedestals.

16. The modular drinking container kit according to claim 15 further including one or more mounting rail systems configured to secure to said interchangeable outer sleeve member external accessory receiving members.

17. The modular drinking container kit according to claim 15 further including one or more external accessories configured to secure to said interchangeable outer sleeve member external accessory receiving members.

18. The modular drinking container kit according to claim 15 wherein said one or more external accessories includes a handle configured to secure to at least one external accessory receiving member of said at least one interchangeable outer sleeve member.

19. The modular drinking container kit according to claim 15 further including one or more mounting devices.

20. The modular drinking container kit according to claim 15 further including mounting hardware.

* * * * *